US007179332B2

(12) United States Patent
Benedetti

(10) Patent No.: US 7,179,332 B2
(45) Date of Patent: Feb. 20, 2007

(54) PROCESS AND APPARATUS FOR ADDING GLUE TO A FLOW OF LOOSE WOODEN MATERIAL

(75) Inventor: Paolo Benedetti, Moden (IT)

(73) Assignee: IMAL S.r.l., S. Damaso (IT)

( * ) Notice: Subject to any disclaimer, the term of this patent is extended or adjusted under 35 U.S.C. 154(b) by 385 days.

(21) Appl. No.: 10/398,906

(22) PCT Filed: Jul. 10, 2001

(86) PCT No.: PCT/IT01/00361

§ 371 (c)(1),
(2), (4) Date: Apr. 11, 2003

(87) PCT Pub. No.: WO02/066214

PCT Pub. Date: Aug. 29, 2002

(65) Prior Publication Data

US 2004/0022936 A1 Feb. 5, 2004

(30) Foreign Application Priority Data

Feb. 23, 2001 (IT) ..... MO2001A0033

(51) Int. Cl.
*B05B 13/04* (2006.01)
*B05B 17/00* (2006.01)

(52) U.S. Cl. ..... 118/303; 118/320; 118/417; 118/418; 428/204

(58) Field of Classification Search ..... 118/303, 118/320, 417, 418; 425/204
See application file for complete search history.

(56) References Cited

U.S. PATENT DOCUMENTS 3,198,655 A * 8/1965 Gisiger ..... 427/212
4,762,274 A * 8/1988 Burls et al. ..... 239/3
6,123,273 A * 9/2000 Loprinzo et al. ..... 239/405
2003/0127763 A1* 7/2003 Stutz ..... 264/40.4

FOREIGN PATENT DOCUMENTS

EP 1 022 103 7/2000
GB 791 554 3/1958

* cited by examiner

*Primary Examiner*—Elena Tsoy
(74) *Attorney, Agent, or Firm*—Young & Thompson

(57) ABSTRACT

A process and apparatus for adding glue to a flow (L) of loose wooden material, in particular a flow of wood chips and fibers, in which the wooden material is introduced through an inlet (3) into a mixer device (4). The glue is sprayed onto the flow of wooden material, internally of the mixer device (4), by nozzles (21) arranged in proximity of the inlet (3). The mixer device (4) is crossed by a flow of hot air. The wooden material, mixed with the glue, after having crossed the mixer device, drawn by the flow of hot air, is removed via an outlet (10) and sent on to subsequent work operations. The invention serves in particular in the manufacturing of wood-chip and fiber panels. The panels obtained are of high quality, being practically devoid of surface imperfections.

6 Claims, 2 Drawing Sheets

PROCESS AND APPARATUS FOR ADDING GLUE TO A FLOW OF LOOSE WOODEN MATERIAL

TECHNICAL FIELD

The invention relates to a process and apparatus for adding glue to a flow of loose wooden or wood-cellulose material, i.e. a flow of wood fibres or chips. The invention is specifically though not exclusively usefully applied in the manufacture of wood-fibre panels and wood-chip panels.

BACKGROUND ART

The invention especially relates to a process in which the loose wooden or wood-cellulose material (for example fibres or chips, fragments, scales, shavings and so on) are united generally by means of a synthetic resin glue.

The thus-agglomerated material is normally used for press-manufacturing of panels.

Various processes and apparatus appear in the prior art for mixing a glue with loose wooden materials. For example, the prior art teaches an apparatus comprising a tubular body, having an inlet and an outlet for the wooden materials, inside which apparatus there is a rotary mixing organ having a plurality of radial blades for continuously agitating the wooden materials; a plurality of nozzles spray the glues onto the wooden materials introduced into the apparatus. The exiting product is a mixture of wooden materials and glue.

On of the problems in the prior art is how to avoid formation of clots of resin unmixed with wood: the clots, in the final panels, are the cause of marked and blotchy surfaces, and are a serious drawback to the quality of the panels themselves.

The main aim of the present invention is to provide a process which enables glue to be mixed with loose wooden materials in such a way as to obtain a well-mixed and glued, homogeneous, uniform and, especially, clot-free product.

A further aim of the invention is to provide an apparatus which is constructionally simple and economical for enacting the above-mentioned process.

An advantage of the invention is that a product is obtained which can be used for manufacturing high-quality fibre or chip panels, practically free of surface defects.

A further advantage is that it provides a highly-productive process.

A still further advantage is that it reduces to a minimum the quantity of wasted and ineffective glue i.e. glue not mixed with the loose wooden materials, with a consequent reduction in glue consumption.

These aims and advantages and others besides are all attained by the invention as it is characterised in the claims that follow.

Further characteristics and advantages of the present invention will better emerge from the detailed description that follows of some preferred but non-exclusive embodiments of the invention, illustrated purely by way of non-limiting examples in the accompanying figures of the drawings, in which.

DISCLOSURE OF DIVISION

Figure 1:
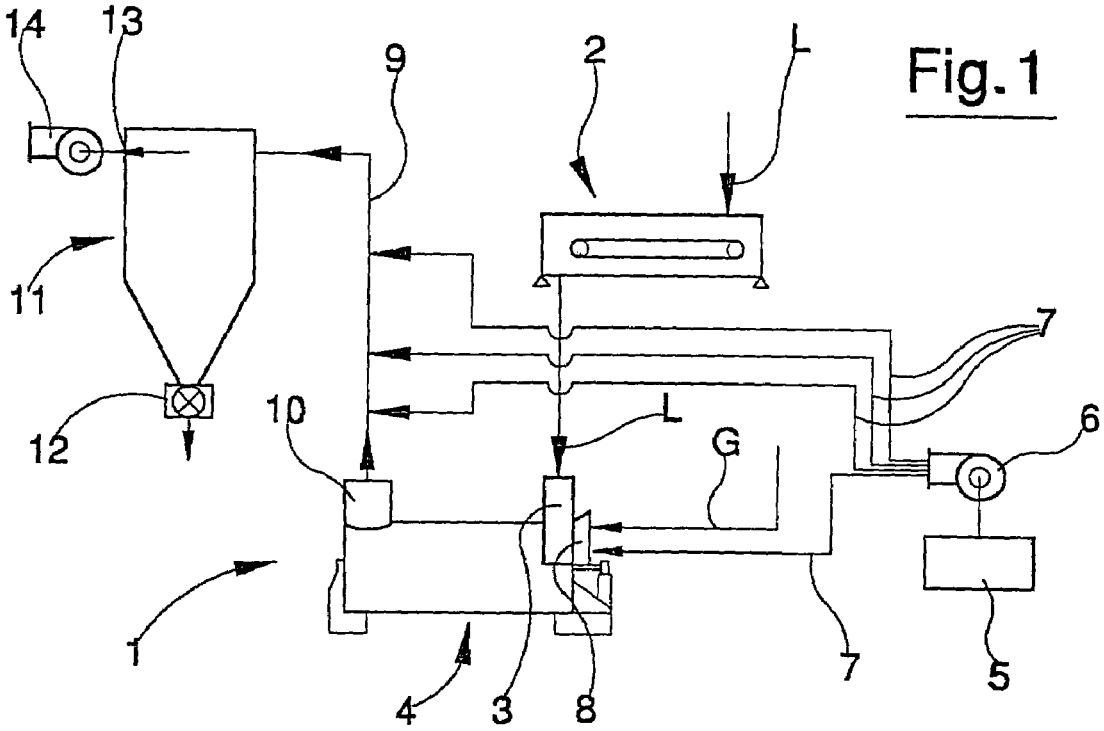
FIG. 1 is a diagram of the apparatus of the invention.

With reference to FIG. 1 of the drawings, 1 denotes in its entirety an apparatus for adding glue to a flow L of loose material constituted by wood chips or fibres. The apparatus can be used in particular in the field of a plant for production of wood-chip panels or wood-fibre panels.

The apparatus 1 comprises a device 2, of known type, for feeding loose material to an inlet 3 of a mixer device 4 (illustrated in more detail in FIGS. 3 and 4), in which the loose material is mixed with a glue sprayed in proximity of the inlet 3 of the mixer device. G denotes a glue infeed.

The apparatus 1 comprises a hot-air generator 5, of known type, and a blower 6 which sends hot air through pipes 7 partly to a second inlet 8 of the mixer device 4 and partly to a discharge pipe 9 connected to an outlet 10 of the mixer device 4. The wood chips or fibres mixed with the glue are sent through the discharge pipe 9 to a separator 11, of known type, having a lower outlet 12 for the material and an upper outlet 13 for the air used in the process. Obviously, means for air suction 14 (of known type) are associated to the upper outlet 13. The material which exits from the lower outlet 12 is sent to the parts of the plant where the subsequent operations for forming panels are carried out.

Figure 2:
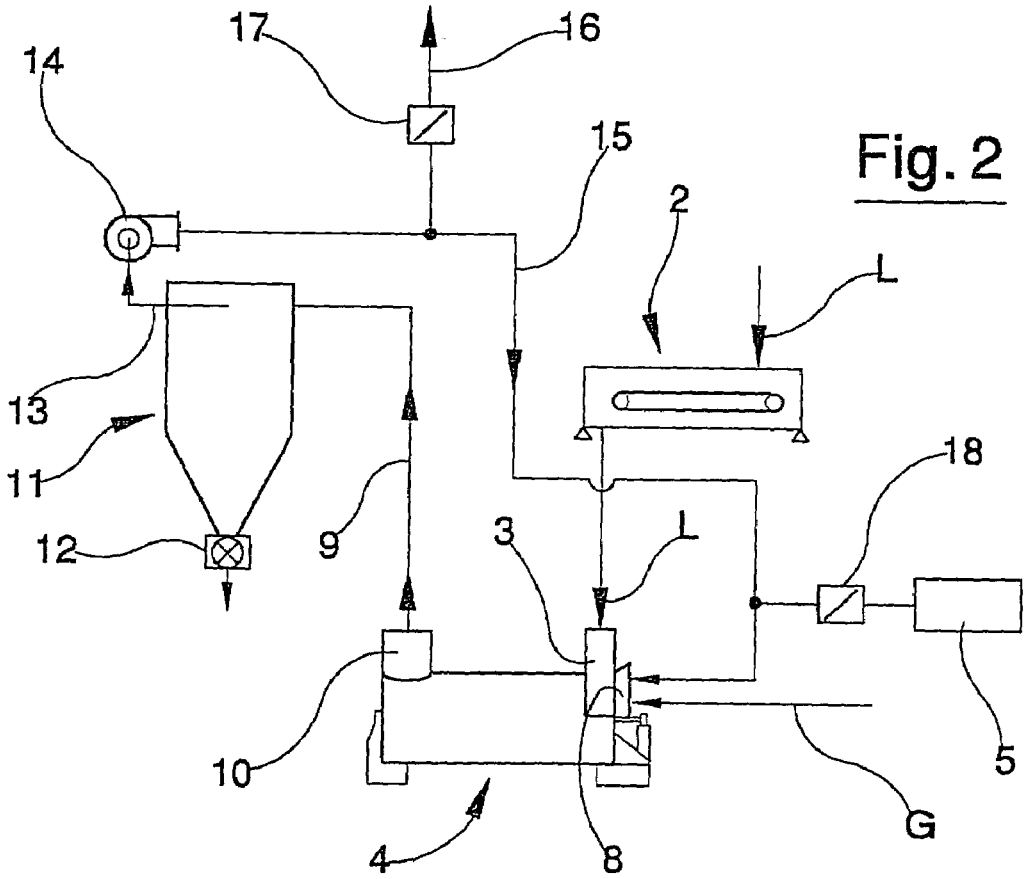
FIG. 2 is a diagram of a second embodiment of the invention.

The apparatus 4 of FIG. 2 comprises a feeding device 2, a mixer device 4, a hot-air generator 5 and a separator 11 similar to those appearing in FIG. 1, for which reason they are denoted using the same numbers. The air outletting from the separator 11 is sent, by the means for air suction 14, through a recycling pipe 15 to the hot-air inlet 8 of the mixer device. The recycling pipe 15 is connected to a discharge pipe 16, regulated by one or more regulation valves 17, and the hot-air generator 5 which, with the help of one or more regulation valves 18, can add hot air to the recycling pipe 15 and maintain the desired air temperature in the mixer device 4.

Figure 3:
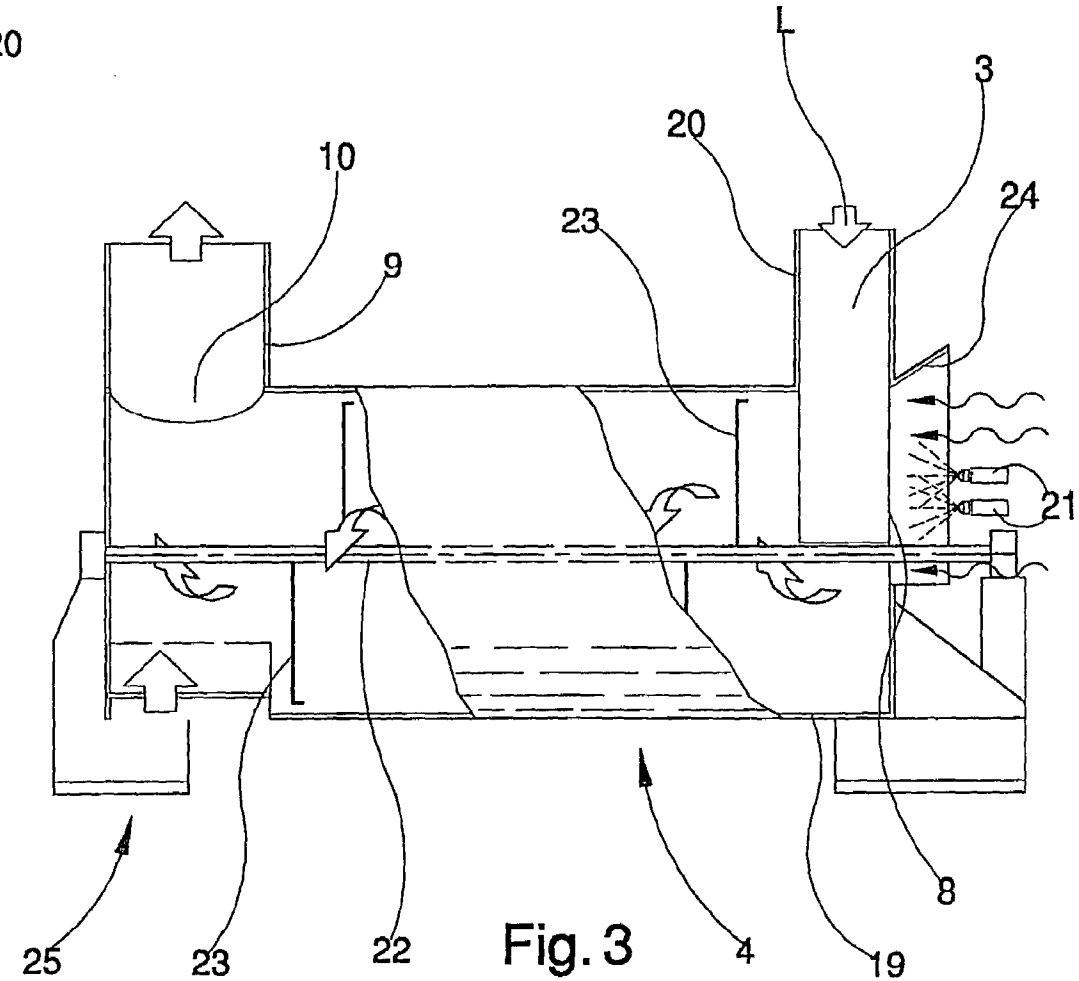
FIG. 3 is a side-view in vertical elevation of a detail of FIGS. 1 or 2, with some parts shown in section.
Figure 4:
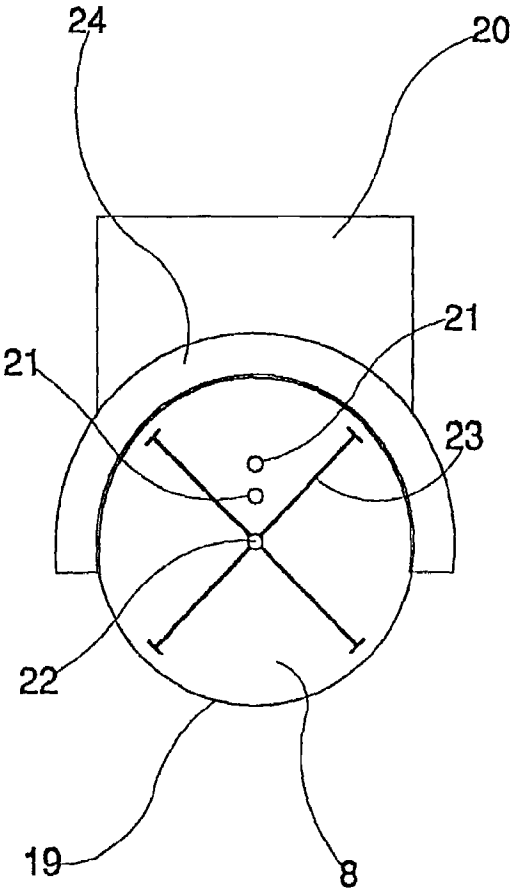
FIG. 4 is a side-view from the right of FIG. 3.

FIGS. 3 and 4 illustrate the mixer device 4 of FIGS. 1 and 2. The mixer device 4 comprises a tubular body 19 having an inlet 3 and an outlet 10 for the loose material. The body 19 is cylindrical with a horizontal axis. The inlet 3 is located at a lower end of a vertical-axis inlet pipe 20 having a rectangular passage section. The outlet 10 is located at a lower end of an outlet pipe, corresponding to the discharge pipe 9, having a vertical axis with a circular passage section. The inlet pipe 20 and the outlet pipe 9 are located above the tubular body 19. The inlet 3 and the outlet 10 are distanced one from the other in the direction of the axis of the tubular body 19. The internal surface of the tubular body 19 is preferably made of a non-stick material so as to prevent any depositing of chips or fibres mixed with glue.

The inlet 3 is predisposed in such a way that the loose material enters laterally into the tubular body 19, transversally to the axis of the body 19. The width of the inlet pipe 20 (by width we mean its dimension in a perpendicular direction to the axis of the tubular body 19), which terminates on a lateral wall of the tubular body 19, is at least eight tenths of the diameter of the tubular body 19. In the present embodiment it is equal in width to the tubular body 19. According to a different criterion, the width of the inlet 3 must be the same as the width of the tubular body 19 at the inlet 3 position, with a possible deviation of 200 mm.

The tubular body 19 exhibits at one end thereof an inlet 8 for the hot-air flow which enters frontally into the tubular body 19 in an axial direction, going from the inlet 3 to the outlet 10 of the loose material (in FIG. 1 from right to left). The hot-air inlet 8 in the tubular body 19 is the same shape as the passage section of the tubular body 19: in the specific case the inlet 8 is a cylindrical aperture with a same diameter as the diameter of the tubular body 19. The hot air flow covers all of the passage section of the tubular body 19 and contacts the flow of wooden material which enters from above, in a transversal direction to the axis, through 2 the upper inlet 3 of the tubular body 19. The hot air flow covers the whole breadth of the wooden material flow.

The mixer device 4 comprises one or more nozzles 21 predisposed in proximity of the upper inlet 3 of the tubular body, which nozzles 21 spray out the glue which is to be added to the flow of loose wooden material. The glue-spraying nozzles 21 are located in front of the open end of the tubular body 19 through which the hot air enters. Further, the nozzles 21 are situated upstream of the inlet 3 of the loose material, "upstream" being with reference to the axial direction in the same direction as the flow of the loose material from the inlet 3 to the outlet 10. The nozzles 21 are arranged so as to be external of the flow of wooden material entering the tubular body 19, so that the hot air flow first reaches the glue, in proximity of the nozzle 21 outlet, and thereafter reaches the loose material entering by the upper inlet 3.

A mixer element, located internally of the tubular body 19, axially extended between the inlet 3 and the outlet 10, rotatably supported at ends thereof, rotates on command to favour mixture of the glue and the wood chips or fibres. The mixer element comprises a central shaft 22 bearing a plurality of radial blades 23. The external surface of the mixer element is preferably made of a non-stick material to prevent any depositing of chips or fibres of the wooden material mixed with glue.

The tubular body 19 is provided, upstream of the hot-air inlet 8, with a wall 24 defining a short conduit having a progressively diminishing section, to improve the flow of hot air into the tubular body 19. The wall 24 causes the hot air flow to converge towards the inlet 8 of the tubular body 19 and enhances the entraining of the glue sprayed from the nozzles 21 towards the inside of the tubular body 19.

The mixer device 4 is provided with means for cooling, of known type and not illustrated, for cooling at least a part of the elements making up the apparatus which come into contact with the flow of loose material and glue, with the aim of obtaining a condensation of water on the internal walls in contact with the flow. In particular, the means for cooling can be predisposed to cool the tubular body 19, the inlet and outlet mouths of the tubular body 19, at least a tract of the discharge pipe 9. The means for cooling also interest the mixer element 22, 23 in order to obtain a water condensation on the external surface in contact with the flow of loose material and glue.

The mixer device 4 is provided with an adjustable air duct 25 located on the lower part of the tubular body 19, below the outlet 10 of the wood-glue mixture, to enhance removal of deposits on the bottom of the tubular body 19.

In an embodiment of the invention, the hot air is sent partly to the inlet 8 at the end of the tubular body 19, and partly to an inlet on the tubular body 19 located downstream of the inlet 8 (for example the lateral inlet constituted by the air duct 25); it would be possible to include a third part of hot air being sent to the discharge pipe.

The hot-air flow has the task of pneumatically transporting the chips or fibres along the tubular body 19 and then along the discharge pipe 9 which terminates in the separator 11. The air is heated so as to enter the tubular body 19 at a temperature of between 30° C. and 110° C. It has been seen that the use of hot air improves the mix quality of the glue and wood, correspondingly improving the quality of the final product, the panels. Preferably the flow-rate of the hot air into the tubular body is comprised between 3 and 15 metres per second.

During operation, the flow L of wooden material is introduced into the tubular body 19. The glue is sprayed into the flow of wooden material through the nozzles 21. The tubular body 19 is axially crossed by the flow of hot air which pneumatically transports the wooden material. The hot air hits the glue first as it issues from the nozzles 21, and immediately after invests the wooden material. The wooden material and the glue are mixed in the tubular body 19 by the mixer element 22, 23. The flow of wooden material, mixed with the glue, after having crossed the tubular body 19, is conveyed to the separator 11 and then on to subsequent operations.

It is also possible to have an injection of supplementary air in the discharge pipe 9 in the embodiment of FIG. 2. In the embodiment of FIG. 1, it is possible to have a hot-air recycling system as it exits from the discharge pipe 9, to reinject the hot air into the mixer device 4.

The invention claimed is:

1. An apparatus for adding glue to a flow (L) of loose wooden material, comprising:

a tubular body having at least one inlet and one outlet for the wooden material, distanced one from the other in a direction corresponding to an axis of the tubular body;

means for pneumatically transporting the wooden material at least from the at least one inlet to the outlet of the tubular body;

a mixer element which revolves internally of the tubular body, which mixer element is axially extended between the at least one inlet and the outlet;

one or more nozzles predisposed in proximity of the at least one inlet of the tubular body which one or more nozzles issue glue to be added to the flow of (L) of wooden material, wherein:

the tubular body exhibits at least one inlet for a flow of air from the means for pneumatically transporting;

the at least one inlet of the wooden material and the at least one inlet of the hot air are predisposed in such a way that the flow of wooden material enters the tubular body in a transversal direction to the axis of the tubular body and the flow of hot air enters the tubular body in an axial direction there-to;

the at least one inlet of wooden material is located on a lateral surface of the tubular body and is at least eight-tenths as wide as a maximum width of the tubular body at a point where the at least one inlet is located, in a transversal direction to the axis of the tubular body;

the at least one inlet of hot air is located at an end of the tubular body and is equal to a section of the tubular body perpendicular to the axis thereof;

the at least one inlet of hot air and the one or more nozzles for the glue are located upstream of the at least one inlet of wooden material, where "upstream" is taken to mean with reference to an axial direction of an advancement direction of flow of wooden material from the at least one inlet to the outlet.

2. The apparatus of claim 1, wherein the means for pneumatically transporting comprise means for generating a flow of hot air which axially crosses the tubular body, comprising at least one hotair generator and means for sending the hot air from the hot-air generator in part to the at least one inlet of the tubular body and in part to at least one zone where wooden material is flowing downstream of the at least one inlet.

3. The apparatus of claim 1, wherein the tubular body is provided with a wall upstream of the at least one inlet of air for pneumatically transporting, which wall defined a short conduit having a progressively decreasing section for guiding a flow of hot air into the tubular body.

4. An apparatus for adding glue to a flow (L) of loose wooden material, comprising:

a tubular body having at least one inlet and one outlet for the wooden material, distanced one from the other in a direction corresponding to an axis of the tubular body;

a pneumatic transport part that pneumatically transports the wooden material at least from the at least one inlet to the outlet of the tubular body;

a mixer element which revolves internally of the tubular body, which mixer element is axially extended between the at least one inlet and the outlet;

one or more nozzles predisposed in proximity of the at least one inlet of the tubular body which one or more nozzles issue glue to be added to the flow of (L) of wooden material, wherein, the tubular body comprises an inlet for a flow of air from the pneumatic transport part, the at least one inlet of the wooden material and the at least one inlet of the hot air are predisposed so that the flow of wooden material enters the tubular body in a transversal direction to the axis of the tubular body and the flow of hot air enters the tubular body in an axial direction there-to, the at least one inlet of wooden material is located on a lateral surface of the tubular body and is at least eight-tenths as wide as a maximum width of the tubular body at a point where the at least one inlet is located, in a transversal direction to the axis of the tubular body, the at least one inlet of hot air is located at an end of the tubular body and is equal to a section of the tubular body perpendicular to the axis thereof, and the at least one inlet of hot air and the one or more nozzles for the glue are located upstream of the at least one inlet of wooden material, where upstream is taken to mean with reference to an axial direction of an advancement direction of flow of wooden material from the at least one inlet to the outlet.

5. The apparatus of claim 4, wherein, the pneumatic transport part generates a flow of hot air which axially crosses the tubular body, and comprises at least one hot-air generator and an air-sending part that sends the hot air from the hot-air generator in part to the at least one inlet of the tubular body and in part to at least one zone where wooden material is flowing downstream of the at least one inlet.

6. The apparatus of claim 4, wherein the tubular body is provided with a wall upstream of the at least one inlet of air for pneumatically transporting, which wall defined a short conduit having a progressively decreasing section for guiding a flow of hot air into the tubular body.

* * * * *